United States Patent [19]

Cannavo et al.

[11] 4,350,096

[45] Sep. 21, 1982

[54] ELECTRIC DEVICE FOR THE IGNITION BY MAGNETIC INDUCTION OF A PYROTECHNIC SUBSTANCE

[75] Inventors: Christian G. Cannavo; Georges Cousin; Andre Espagnacq; Jacques X. Frayssac, all of Bourges; Loic Y. Laine, Saint-Doulchard; Daniel J. Midrouillet; Andre M. Pintenat, both of Bourges; Jean B. Reboux, Savigny-sur-Orge, all of France

[73] Assignee: Etat Francais represente par le Delegation General pour l'Armement, Paris, France

[21] Appl. No.: 84,882

[22] Filed: Oct. 15, 1979

[30] Foreign Application Priority Data

Oct. 13, 1978 [FR] France ..... 78 29209

[51] Int. Cl.[3] ..... F42B 5/08; F42B 9/08

[52] U.S. Cl. ..... 102/209; 42/84; 102/202.5; 102/472

[58] Field of Search ..... 102/202.2, 202.5, 209, 102/472; 42/84; 89/28 R

[56] References Cited

U.S. PATENT DOCUMENTS 2,459,854 1/1949 Swift, Jr. ..... 102/209
2,919,627 1/1960 Cardona et al. ..... 102/209
3,185,093 5/1965 Holinbeck ..... 102/202.5
3,809,964 5/1974 Ceyrat ..... 89/28 R
4,145,968 3/1979 Klein ..... 102/202.2

FOREIGN PATENT DOCUMENTS 1235844 6/1971 United Kingdom ..... 89/28 R

*Primary Examiner*—Charles T. Jordan
*Attorney, Agent, or Firm*—Stevens, Davis, Miller & Mosher

[57] ABSTRACT

This invention relates to an electric device for the ignition of pyrotechnic substances and more particularly an electric device which operates by electromagnetic induction.

The device comprises: An induced member 22 placed in a cartridge containing a pyrotechnic substance within a circular opening of the bottom of the case 20, and an inductor located in a cavity 24 made in the thickness of a firing plate 23. The induced member has at least one open turn 31 connected to at least one heating filament 32, mounted on a thin insulating pellet 30, the inductor is a spiroidal winding 25 whose frequency defines the operating frequency of the generator; the inductor comprises a thermal protection means, a mechanical protection means and sealing means.

The device can be used in particular in the field of artillery.

12 Claims, 11 Drawing Figures

Figure 4A:
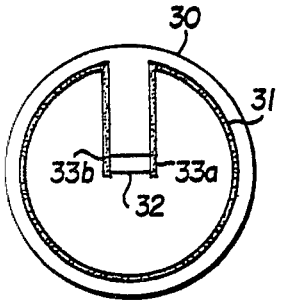

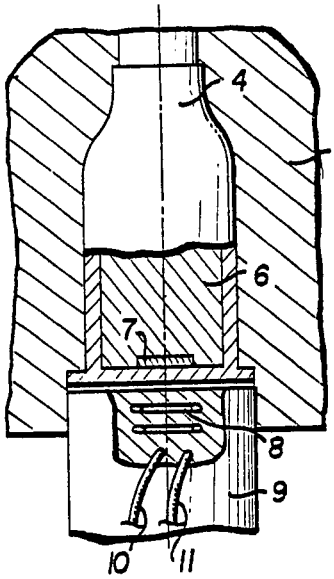
FIG. 1a
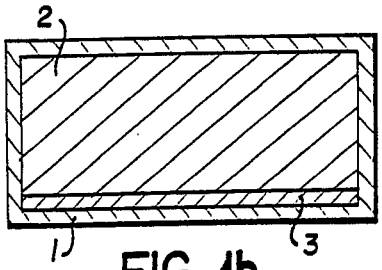
FIG. 1b
FIG. 2
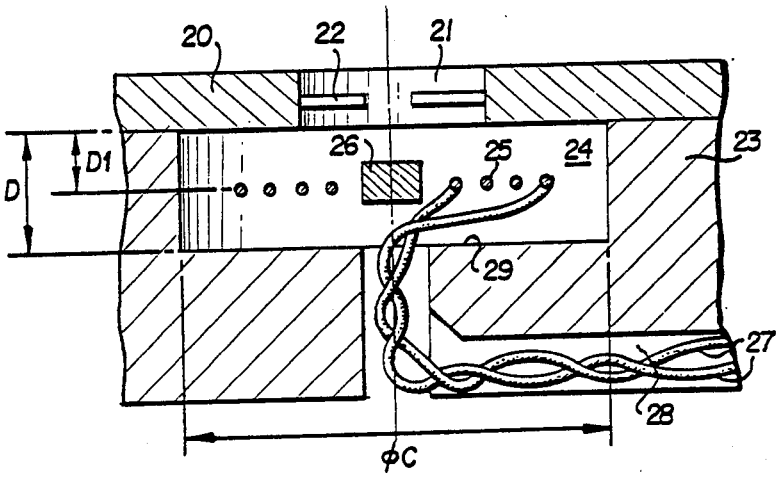
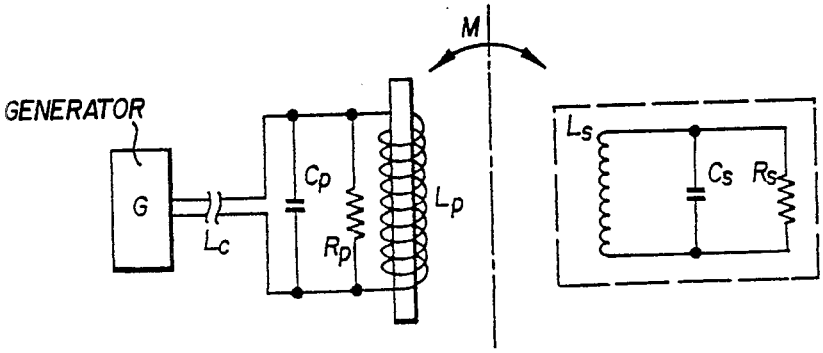
FIG. 3

ELECTRIC DEVICE FOR THE IGNITION BY MAGNETIC INDUCTION OF A PYROTECHNIC SUBSTANCE

This invention relates to the technical field of ignition devices for pyrotechnic substances; more precisely, it relates to an electric device which operates by electromagnetic induction.

The invention as described refers more particularly, but not exclusively, to an igniting device for artillery and rocket propulsive charges or propulsive charges for light and smoke missiles such as, for instance, illuminating, tracer, smoke-producing, incendiary and gas-generating devices.

An electric ignition device for a pyrotechnic substance which operates by electromagnetic induction comprises two elements, namely:

a first element which constitutes an inductor and which is transversed by an electric current supplied by a pulsating or alternating source of energy of high frequency and limited duration released at the moment of the firing:

a second element, which constitutes the induced member and which is coupled electronically to the inductor, this induced member being arranged in contact with or in the vicinity of the pyrotechnic substance which is sensitive to heating, which serves possibly as primary igniter for a larger pyrotechnic charge.

From French Patent No. 2 159 787, British Patent No. 1,235,844 and German Patent No. 2 421 908 there is already known a device which operates on the principle of the heating by induction of a resistant material placed in a pyrotechnic substance.

The advantages provided by an electromagnetic induction ignition device over the conventional devices operating by means of electrical connections are multiple. Among these advantages mention may be made in particular of the following:

the absence of a physical connection between the source of electrical energy and the heating element contained in the pyrotechnic substance, which avoids on the one hand poor electrical contacts and on the other hand the necessity of positioning these contacts precisely;

the possibility of producing a combustible initiator, which is necessary in applications in which one desires to avoid solid residues during or after the operation of the primer;

a high degree of immunity to electrostatic charges, which have the effect of resulting in a possible unwanted ignition.

The object of the present invention is to provide an ignition device based on electromagnetic induction which not only provides the conventional advantages of ignition by induction but furthermore makes it possible to reconcile two opposing requirements—a probability of controlled ignition approaching unity and, at the same time, a probability of untimely or accidental ignition which lies at a very low value.

One characteristic of the electric ignition device for a pyrotechnic substance in accordance with the invention comprising on the one hand an induced member placed in the device to be ignited and on the other hand an inductor placed in the thickness of the breech of the weapon is that the armature is formed of at least one open turn made in a material of high electrical conductivity; within the middle of this turn there is arranged at least one heating element formed of a resistant filament made of a material which can advantageously be soldered to the material of the turn, the assembly thus formed being supported by a thin insulating wafer.

In accordance with another feature of the invention, the inductor is formed of a flat spiroidal winding in the central part of which a low-loss magnetic core may be arranged.

In accordance with still another characteristic, the inductor is placed in an open cavity provided in the ignition plate and means are provided in order to protect this inductor mechanically and thermally.

In accordance with another feature of the invention, the walls of the open cavity provided in the ignition plate are made strongly conductive.

In accordance with another characteristic, the turn or turns are arranged on an insulating pellet whose free face may be provided with means for protection against the electromagnetic radiations produced by radar or radio transmitters.

In accordance with another characteristic, the inductor is firmly secured in a material which is transparent to electromagnetic radiations, has high mechanical properties and is resistant to corrosion and temperature, this material closely fitting the shape of the cavity provided in the ignition plate.

In accordance with another characteristic, the inductor is imprisoned between a shield and a block, the assembly formed by the shield, inductor and block being securely fastened to an ignition plate by a retaining ring, sealing means being provided between the retaining ring and the ignition plate and between the retaining ring and the shield.

One more specific advantage of the electromagnetic induction ignition device of the invention resides in the provision of an inductor which, placed in the environment in the chamber of a gun resists the thermal and mechanical effects produced essentially by the combustion of the propulsive charge.

Another advantage resides in the fact that a high probability of controlled ignition is satisfied despite mechanical and geometrical imperfections of the system to be ignited.

Other characteristics and advantages provided by the invention will become evident during the course of the following detailed description, given with reference to the accompanying drawings, which show, by way of illustration and not of limitation, several embodiments of a device for the ignition by induction of a pyrotechnic substance contained in a high or medium caliber artillery cartridge, the ignition plate being the breech or firing plate of a gun.

Figure 4B:
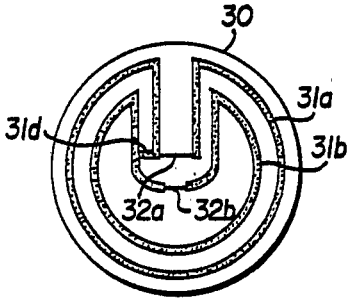
Figure 4C:
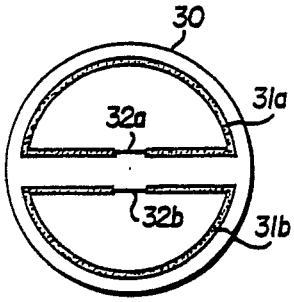
Figure 4D:
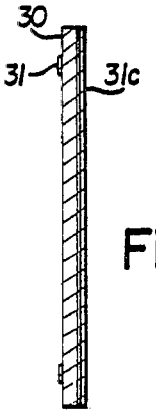
Figure 5:
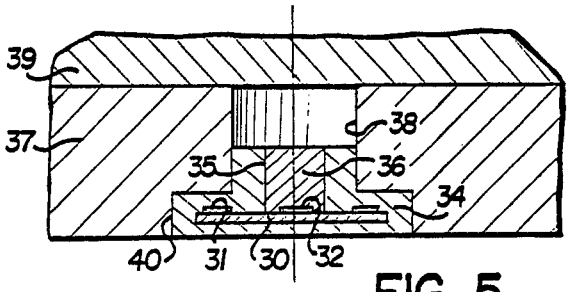
Figure 6A:
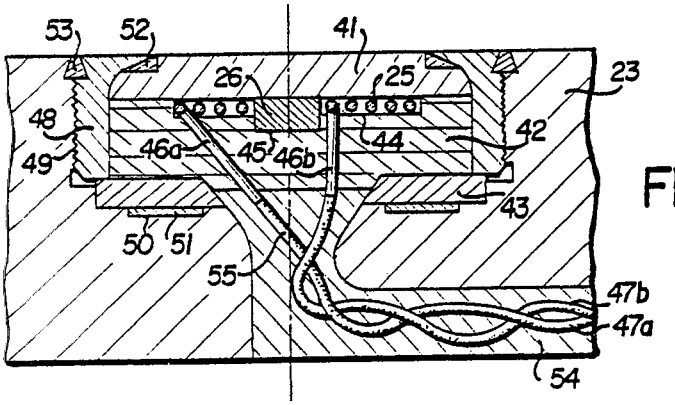
Figure 6B:
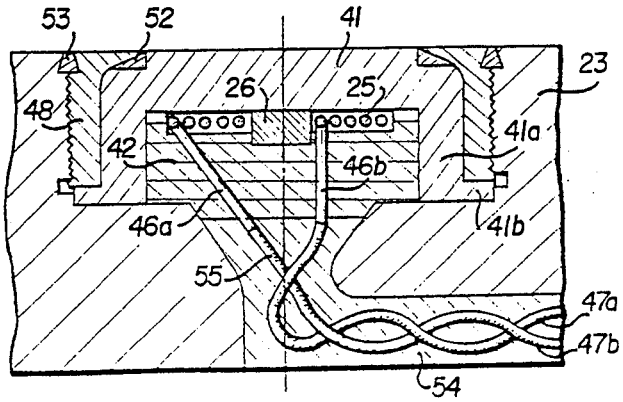

In these drawings:

FIGS. 1*a* and 1*b* show an ignition device in accordance with the prior art, FIG. 2 shows an ignition device in accordance with the invention, FIG. 3 shows an electrical model of the device in accordance with the invention, FIGS. 4*a*, 4*b*, 4*c*, and 4*d* show four embodiments of the element which the induced member constitutes, FIG. 5 shows the mounting of an armature in an artillery cartridge, FIGS. 6*a*, 6*b* show two variant embodiments of an ignition device.

FIG. 1 shows, in accordance with the prior art, an ignition device of a pyrotechnic charge applied to artillery, as described for example in the aforementioned French patent No. 2 159 787.

FIG. 1*a* shows the assembly of the device and FIG. 1*b* shows the details of construction of the initiator placed in the artillery cartridge.

In FIG. 1*a*, the case 4 of an artillery cartridge is engaged in the chamber 5 of a gun; said cartridge contains a propellent charge 6 and an initiator 7 of electromagnetic induction type. An inductor 8, arranged in the breech 9 of the gun, is traversed by an alternating current supplied by an electric generator connected to the input terminals 10 and 11 of this inductor and triggered at the moment of firing.

FIG. 1*b* shows the details of construction of the initiator 7 of the electromagnetic induction type. This initiator has a jacket 1 made of an insulating material and contains the pyrotechnic substance 2 which is sensitive to heating. A metallic element 3 which constitutes the induced member is placed within this jacket in contact with or in the vicinity of the pyrotechnic substance.

FIG. 2 shows, in accordance with the invention, an embodiment of an electric ignition device of the propellent charge of a projectile shot by a gun; only the parts concerned in the invention, the inductor part and the induced part of the device are shown.

The bottom of the case 20 of the cartridge of non-conductive material contains in its central region a circular opening 21 within which the element 22 which constitutes the armature of the device is arranged. In the thickness of the steel firing plate 23, opposite the induced member there is provided a cylindrical cavity 24 in which the element which constitutes the inductor of the device is arranged. This inductor comprises a spiroidal winding 25 of low loss and a ferrite core 26 located along the axis of the winding; the purpose of this core is to concentrate the electromagnetic flux of the inductor in the induced region.

The walls 29 of the cavity 24 are made conductive by the depositing of a layer of small thickness of a metal which is characterized by a high specific conductivity, for instance copper, silver, etc.; the thickness of this metallic layer is greater than the depth of penetration of the electric current induced at the operating frequency of the high frequency signal which feeds the inductor.

In accordance with another variant embodiment, the cavity may be jacketed by a metal case made of a metal of high electrical conductivity; the inner walls of this cavity can be machined so as to increase its properties of adherence to the filling materials.

The output connections 27 of the winding 25 are directed towards the rear of the firing plate and then twisted within an output conduit 28.

The inductor is protected thermally and mechanically by coating materials which are suitably arranged—an upper coat of material which is transparent to electromagnetic radiations and is of high mechanical and thermal stress and constitutes a shield, and subjacent layers which constitute a means of mechanical protection of the inductor.

The dimensions, and particularly the depth D and the diameter $\phi_C$ of the cavity must be minimized in order substantially to reduce the geometrical and mechanical requirements. However, they must be sufficiently large so that the losses formed by the power dissipated in the mass of metal are acceptable. The distance $D_1$ between the bottom of the case 20 and the winding must be sufficient so that the coating layer which constitutes the heat shield retains full mechanical and thermal effectiveness while not excessively attenuating the magnetic field. The winding is advantageously constructed in the form of a "pancake," having one or more layers of wires.

FIG. 3 shows, in accordance with the invention, the electrical model of the device described in FIG. 2. The inductive part or primary is located to the left of the axis which simulates the plane of the firing plate, the induced part or secondary is located to the right of this axis. The winding of the inductor has an inductance value $L_p$, which is greater than the self-inductance Lc of the connection between the inductor and the generator G, for instance four to ten times greater, depending on the length of the connection. A power capacitance of value Cp is connected to the terminals of the winding to constitute an anti-resonant circuit, the resonant frequency of which is advantageously selected so as to assure for the inductor/induced member couple an excellent conjugated coupling of good efficiency. The resonant frequency constitutes the optimal operating frequency of the generator, that is to say that for which the current delivered by it is minimal.

The resistance Rp represents a fictitious resistance, equivalent to the losses of the conductor and comprising in particular the chemical resistance of the winding, the losses induced in the walls of the cavity, etc. The winding may be made of divided wires such as stranded wire or of solid wire, and the walls of the cavity are made strongly conductive by the depositing of a metallic layer of high conductivity.

The element which constitutes the induced member may be represented by a coil of value $L_s$ coupled electromagnetically to the inductor; to the terminals of this coil there is connected a resistive filament of value $R_s$. In order to increase the transfer of high frequency energy induced in the coil $L_s$ in the load resistor $R_s$, the impedance of the coil $L_s$ is advantageously of the same order of magnitude as the resistor $R_s$ while remaining very low, less than one Ω, so as to make the system very insensitive to external radiation. The coupling M of the primary and secondary parts is increased by minimizing their relative spacing and inserting a ferrite core in the winding of the inductor.

The generator G which supplies the inductive energy must operate on a frequency located beyond industrial frequencies; the frequency of operation must be sufficiently high, on the order of MHz, in order to reduce the physical dimensions of the device and improve the coupling between inductor and induced member, but not too high in order to avoid the dielectric losses in the coating material. The generator G is of the type which can be triggered at the moment of firing and supplies a signal of a duration on the order of 10 to 100 milliseconds.

FIGS. 4*a*, 4*b*, 4*c* and 4*d* show details of the construction of the element constituting the induced member 22, shown in FIG. 2.

In FIG. 4*a*, the induced member is developed in accordance with the printed-circuit technique on the surface of a thin insulating wafer 30, for instance of epoxy glass; this armature is composed of an open turn 31 made in a material characterized by a substantial specific conductivity and of at least one resistant filament 32 arranged at the center of the wafer, the ends of this filament being connected to the turn by two radial connections 33*a* and 33*b*. The filament which constitutes the heating element is made of a material whose specific resistivity is high and which has mechanical properties which make it possible to solder it to the connections of the turn. One example of such a material is a wire marketed in France under the name "PHYNOX." The diameter of this filament is on the order of a tenth of a millimeter. The electrical energy necessary to bring this filament to the temperature of ignition of the pyrotechnic substance is a function of the nature of this substance and of the connection between the filament and the pyrotechnic substance. The energy supplied to the filament under normal conditions of use must be definitely greater than that which the induced member can normally take up when the ammunition is accidentally placed in a powerful electromagnetic field of radar or radio transmitter. At this stage, the invention is similar to the technique of the ignition of pyrotechnic substances by heating, which is well known to the man skilled in the art.

In order to achieve a high probability of controlled operation, the induced member may have two independent turns, each of these turns containing a heating filament.

In FIG. 4*b*, two turns 31*a* and 31*b* which can be electrically insulated or contacted by a bridge 31*d* are arranged concentrically on the surface of the insulating wafer 30. These turns 31*a* and 31*b* are connected to heating elements 32*a* and 32*b* respectively, located in the central portion of the wafer.

In FIG. 4*c*, two turns 31*a* and 31*b*, insulated electrically or having a common point, are arranged in adjacent fashion on the surface of the insulating wafer 30. These turns 31*a* and 31*b* are connected to heating elements 32*a* and 32*b* respectively located in the central portion of the wafer.

The wafer 30 may be provided with a means for protection against electromagnetic radiations produced by radar (FIG. 4*d*) so as to prevent accidental firing under their influence, which risk is all the greater the higher the frequency, since the power transmitted by induction to a surface increases as the square root of the frequency. This means of protection can be arranged on the free face of the pellet and may consist, for instance, of a solid conductive screen 31*c* of uniform thickness which fully or partially masks the turn, or by a conductive grid.

This manner of protection from electromagnetic radiations is advantageous since it acts whatever the position of the radar illuminator with respect to the initiator and the induced turn.

As a matter of fact, in the event that the screen is located between the induced turn and the radar illuminator, the screen acts as a filter, that is to say it has a negligible effect on the operating frequency (1 MHz) but it acts all the more the greater the amount by which the frequency of the signal is greater than the cutout frequency of the screen; its thickness is selected as a function of the resistivity, permeability of the material constituting it, and the frequency for which it is desired to be protected, in such a manner that this thickness is on the order of magnitude of the depth of the current induced at this frequency.

In the event that the turn is located between the radar and the screen, the latter acts in accordance with another phenomenon. As a matter of fact, the radar illuminator induces eddy currents in the screen which in their turn create a secondary field which is opposite to the incident field. The resultant field is the vector sum of the field produced by the illuminator and the field produced by the eddy currents. In the vicinity of the screen, the resultant field is practically zero and it increases as one moves away from the screen. Accordingly, the induced turn should be arranged as close as possible to the screen so that it is protected as effectively as possible from the field produced by the radar.

In one particular embodiment which permits protection against frequencies on the order of GHz, solid screens of thickness e have been used, of different materials such as

| | e in micrometers |
|---|---|
| Copper | 2 |
| Constantan | 4 |
| Nickel | 5 |
| Manganin | 10 |

In another embodiment, the shape of the screen has been adjusted so as to artificially increase the resistance of the electrical circuit and also decrease the attenuation at the operating frequency of the inductor. In order to do this there has been used a copper grid of a thickness of 70 μm, a mesh width of 6 mm, and a line width of 0.3 mm.

FIG. 5 shows a manner of mounting in which the induced armature 30 is embedded in a housing 34 made of combustible or non-combustible insulating material. This housing comprises a cavity 35 which debouches on the filament or filaments 32, this cavity being filled with a pyrotechnic composition which is sensitive to the hot wire. A hole 38 is drilled in the bottom of the case 37 and debouches within the case towards the propulsive charge 39. Furthermore, this hole contains a facing 40 in which the housing 34 is fitted, it being held there by gluing.

FIG. 6 shows two variants of the mounting of the inductor in the breech (or firing plate). The inductor is firmly blocked in a material transparent to electromagnetic radiations and resistant to a temperature of between 800° and 1000° C. for 10 milliseconds and to a pressure of the order of 3000 bars for 5 milliseconds, whose compressive strength is greater than 1000 daN/cm$^2$ and whose rate of elongation is greater than 2%. This material may be an organic matrix which is resistant to a temperature of less than 500° C., reinforced by means of fillers such as fibers or fabrics. This material may be formed for instance:

of staple fibers of asbestos, glass or silica or of an asbestos or silica fabric coated by a cresyl, phenolic, phenoplast, polyamide, polyimide or silicone resin, of "whiskers," that is to say non-metallic filamentary single crystals of a length of less than 50 mm and a diameter of less than 100 μm (trichites), such as for instance trichites of corundum ($Al_2O_3$), coated in a cresyl, phenolic, phenoplast, polyamide, polyimide or silicone resin.

FIG. 6*a* shows one manner of mounting in which the inductor 25 is arranged between a shield 41 and a block 42 held applied against a support plate 43.

The shield may be formed, for instance, of the aforementioned materials. The block 42 and the support plate 43 may be formed, for instance, of:

the aforementioned materials, a glass or cotton fabric coated in a cresyl, phenolic, phenoplast, polyamide, polyimide or silicone resin, a three-dimensional laminate of asbestos, glass or silica coated in a cresyl, phenolic, phenoplast, polyamide, polyimide or silicone resin.

The shield 41 is preferably made of DURESTOS material formed of asbestos staple fibers coated in a cresylic resin or of 2 D formed by a glass fabric coated in a phenolic resin, marketed by SNIAS. It may also be formed of one or more layers of DURESTOS interposed between one or more layers of 2 D, the face which is turned towards the firing chamber being of DURESTOS. The block 42 is made of DURESTOS; it has on the one hand a cylindrical cavity 44 in which the spiroidal winding 25 of the inductor is held by araldite glue and on the other hand a housing 45 for the ferrite core 26. Two holes 46*a* and 46*b* permit the wires 47*a* and 47*b* to emerge towards the rear of the firing plate 23. The shield 41 and the block 42 are glued with CAF silicones marketed by RHODOR SIL SILICONES and are arranged in a steel retaining ring 48 screwed into the firing plate 23 via the thread 49. This retaining ring comes to rest against a support plate 43 of DURESTOS material. This support plate 43 is arranged at the bottom of the cavity of the firing plate within which there is developed a groove 50 in which there is housed a washer 51 of cotton coated with silicones which assures the rear sealing of the mounting. A washer 52, preferably of copper, which is in intimate contact with the retaining ring and a copper packing 53 developed in a dove-tailed groove between the retaining ring 48 and the firing ring 23 assure the front sealing. At the rear of the plate, the wires 47*a* and 47*b* can be embedded in silicones or araldite 54; furthermore, they are protected electrically by a thermal rectractable sheathing 55.

FIG. 6*b* shows a variant of the preceding mounting in which the shield 41 is extended by a cylindrical portion 41*a* and a shoulder 41*b* which is held against the bottom of the cavity of the firing plate by the retaining ring 48. Within the cylindrical portion 41*a* there is housed the block 42 which maintains the armature coil 25 and the ferrite core 26.

In these two variants, the inside of the retaining ring receives a metal deposit identical to that made on the walls of the cavity.

As previously mentioned the turn constituting the armature can be rigidly connected with a thin flat support; the same may be true of the inductor made in the form of a flat spiroidal winding arranged in the immediate vicinity of the armature.

We claim:

1. An electric magnetic induction ignition device for a pyrotechnic substance to be ignited by means of a weapon, comprising an induced member arranged in contact with the pyrotechnic substance, an inductor connected to a current generator and located opposite the induced member and coupled electromagnetically to it, said inductor located in a cavity open to electromagnetic radiations produced in the breech of said weapon, the induced member being formed of at least one open turn made of a material of high specific conductivity, at least one resistive element terminating the opening of each of said turns, the impedance of said turn being substantially the same as the impedance of said terminating element.

2. A device according to claim 1, wherein the inductor is a spiroidal winding and comprises a mechanical protection means, a thermal protection means and sealing means.

3. A device according to claim 2, wherein said inductor is housed in a steel cavity, said steel cavity comprises a means for increasing the electrical conductivity of the walls comprising a film deposit of a metal of high specific conductivity.

4. A device according to claim 1 wherein the turn is arranged on an insulating pellet.

5. A device according to claim 4, wherein the turn is made of an insulating support manufactured by a printed circuit technique.

6. A device according to claim 1 wherein said induced member comprises two open turns which are independent and are each connected to a resistive filament.

7. A device according to claim 6, whereby the two turns are concentric.

8. A device according to claim 7, whereby the two turns are adjacent.

9. A device according to claim 1 wherein said induced member comprises a conductive screen of uniform thickness arranged on the free face of an insulating wafer at least partially masking the turn.

10. A device according to claim 1 wherein the turn constituting the induced member is rigidly connected with a thin flat support in order to cooperate with an inductor comprising a flat spiroidal winding arranged in the immediate vicinity of the induced member.

11. A device according to claim 2, wherein said inductor is housed in a steel cavity, said steel cavity comprises a means for increasing the electrical conductivity of the walls comprising a chamber made of a metal of high specific conductivity.

12. A device according to claim 1 wherein said induced member comprises two open turns which have a point in common and each of said turns is connected to a resistive filament.

* * * * *